United States Patent [19]

Moore

[11] 4,088,236

[45] May 9, 1978

[54] MULTIPLE USE EARTH WORKING MACHINE

[75] Inventor: Emanuel M. Moore, Pine Bluff, Ark.

[73] Assignee: B. B. and M. Inc., Pine Bluff, Ark.; a part interest

[21] Appl. No.: 807,810

[22] Filed: Jun. 17, 1977

[51] Int. Cl.[2] ..... B65G 47/02; E02F 3/76

[52] U.S. Cl. ..... 214/90 R; 37/2 R; 37/117.5

[58] Field of Search ..... 214/90 R, 90 A, 91 R, 214/91 A, 145 R, 145 A; 37/117.5; 172/438; 198/315, 316, 318

[56] References Cited

U.S. PATENT DOCUMENTS

| | | | |
|---|---|---|---|
| 2,855,116 | 10/1958 | Moore | 214/91 R |
| 3,623,597 | 10/1971 | Arndt | 198/318 X |

*Primary Examiner*—Robert G. Sheridan

*Attorney, Agent, or Firm*—Clarence A. O'Brien; Harvey B. Jacobson

[57] ABSTRACT

An earth working machine in the form of a motorized vehicle having a longitudinally extending, upwardly and rearwardly inclined belt-type conveyor combined with a transversely extending conveyor at the rear thereof rigidly supported in relation to the rear discharge end of the longitudinal conveyor. The forward end of the longitudinal conveyor or machine is provided with interchangeable earth working of handling implements so that the machine may be used for multiple purposes. The longitudinal conveyor has the forward end portion supported from the machine by a vertically pivotal subframe to enable variation in the elevational position of the longitudinal conveyor. The rearward portion of the longitudinal conveyor is supported by a transverse, horizontal support member which does not constrain the rearward portion of the longitudinal conveyor from moving in a vertical direction. The transverse conveyor is provided with supporting wheels which in the normal position of the conveyors are spaced from the ground surface but which will support the transverse conveyor and the rearward portion of the longitudinal conveyor from the ground surface when the forward portion of the longitudinal conveyor is elevated thereby rendering the machine useful for various earth working or handling procedures.

12 Claims, 24 Drawing Figures

MULTIPLE USE EARTH WORKING MACHINE

BACKGROUND OF THE INVENTION

1. Field of the Invention

The present invention generally relates to an earth working machine employing longitudinal and transverse conveyors associated with each other and an earth working or handling implement at the forward end of the longitudinal conveyor by which earth or other material will be conveyed from a point in front of the machine to a rear transverse conveyor and discharged laterally of the machine.

2. Description of the Prior Art

My prior U.S. Pat. No. 2,855,116, issued Oct. 7, 1958, discloses an earth moving apparatus incorporating a longitudinal conveyor and transverse conveyor with an earth engaging apparatus at the forward end of the longitudinal conveyor and a mounting for the longitudinal conveyor at its rearward end to provide pivotal supporting engagement for supporting the longitudinal conveyor from the vehicle on which it is mounted. While the previous device operated satisfactorily for the purposes intended, the utility thereof was somewhat restricted due to the specific structural relationship between the longitudinal and transverse conveyors and the various adjustment means for controlling, positioning and operation of the machine, particularly the conveyors and earth working or handling implements at the forward end of the conveyor.

SUMMARY OF THE INVENTION

An object of the present invention is to provide an earth working machine in the form of a motorized vehicle capable of multiple uses in the earth working and earth handling field and which includes a longitudinal conveyor mounted on the vehicle and a transverse conveyor at the rear of the longitudinal conveyor and supported rigidly in relation thereto in order to maintain a constant and fixed relationship between the longitudinal and transverse conveyors.

Another object of the present invention is to provide an earth working machine, in accordance with the preceding object, in which the forward end of the machine or longitudinal conveyor is provided with interchangeable earth working or handling apparatuses to facilitate working or handling of earth located forwardly of the machine.

A further object of the invention is to provide an earth working machine, in accordance with the preceding objects, having a grader blade mounted thereon by which the earth may be graded to one side of the machine during one pass thereof while at the same time, the earth that had been discharged by the grader blade in the previous pass of the machine is being picked up and handled by the conveyors.

Still another object of the present invention is to provide an earth working machine in which the rearward end of the longitudinal conveyor is supported from the machine by a support structure which does not constrain the rearward end of the longitudinal conveyor and the transverse conveyor rigid therewith from moving vertically away from supporting engagement with the machine.

A still further object of the present invention is to provide an earth working machine, in accordance with the preceding objects, in which the transverse conveyor is provided with ground engaging supporting means that is normally spaced from the supporting surface when the longitudinal conveyor is in a forwardly and downwardly inclined relation with the ground engaging means becoming effective to support the transverse conveyor and rearward end portion of the longitudinal conveyor as the forward end of the longitudinal conveyor is moved upwardly by an adjustable subframe thereby enabling a wider range of relative movement between the conveyors and the remainder of the machine.

Yet another important object of the present invention is to provide an earth working machine, in accordance with the preceding object, in which the forward end of the machine or longitudinal conveyor is provided with a scoop-like earth engaging apparatus, a scoop or shovel-like device with a closure gate thereon, a blade or an auger device which enables holes to be drilled in the earth surface to facilitate working or handling thereof.

Another significant feature of the present invention is to provide an earth working machine in the form of a mobile vehicle operated by a single operator at an operator station and including a powered subframe which can swing a foward end portion of a longitudinal conveyor vertically and move the forward end portion of the longitudinal conveyor laterally of the machine to facilitate earth working or handling over a wider work area and a vertical work face, thereby greatly facilitating various excavation procedures.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 11 is a fragmental, enlarged sectional view of the transverse conveyor structure.

DESCRIPTION OF THE PREFERRED EMBODIMENTS

Figure 1:
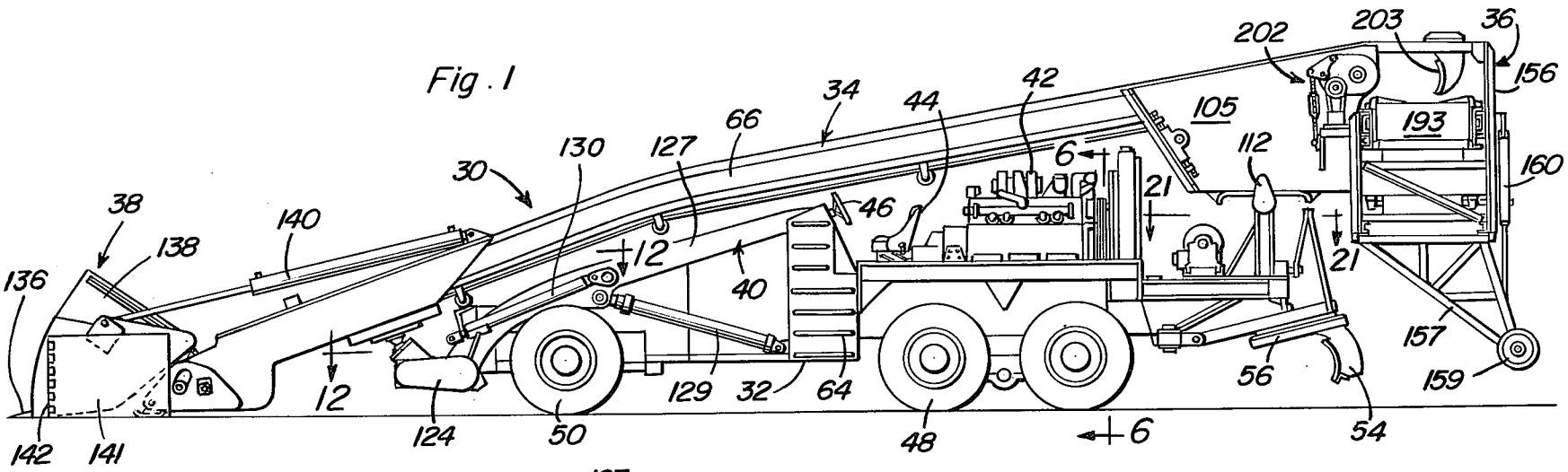
FIG. 1 is a side elevational view of the multiple use earth working machine of the present invention illustrating the orientation of the components when in operative condition.
Figure 2:
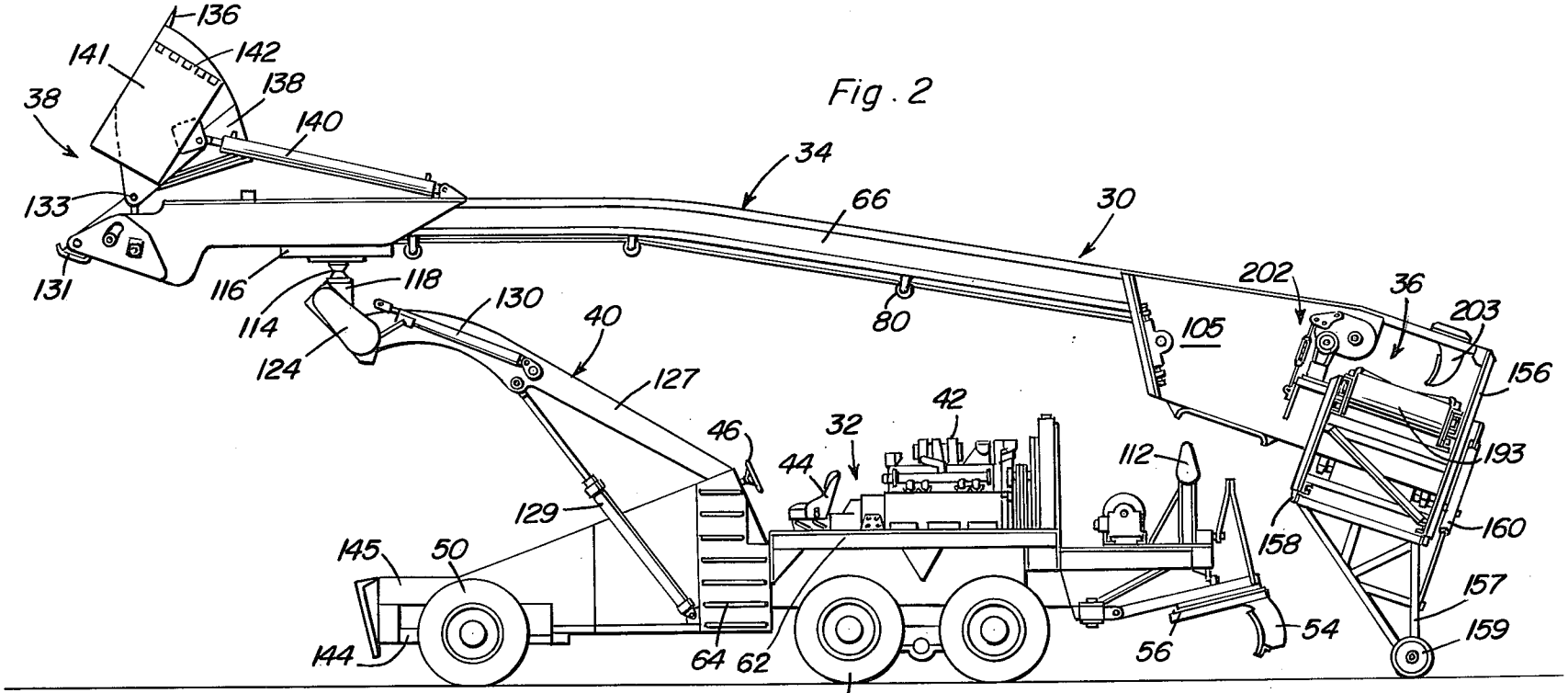
FIG. 2 is a side elevational view of the machine illustrating the longitudinal conveyor elevated at its forward end and the supporting wheels for the transverse conveyor and rearward end portion of the longitudinal conveyor engaging the ground surface and supporting the rearward portion of the longitudinal conveyor and transverse conveyor in spaced relation to the vehicle.
Figure 6:
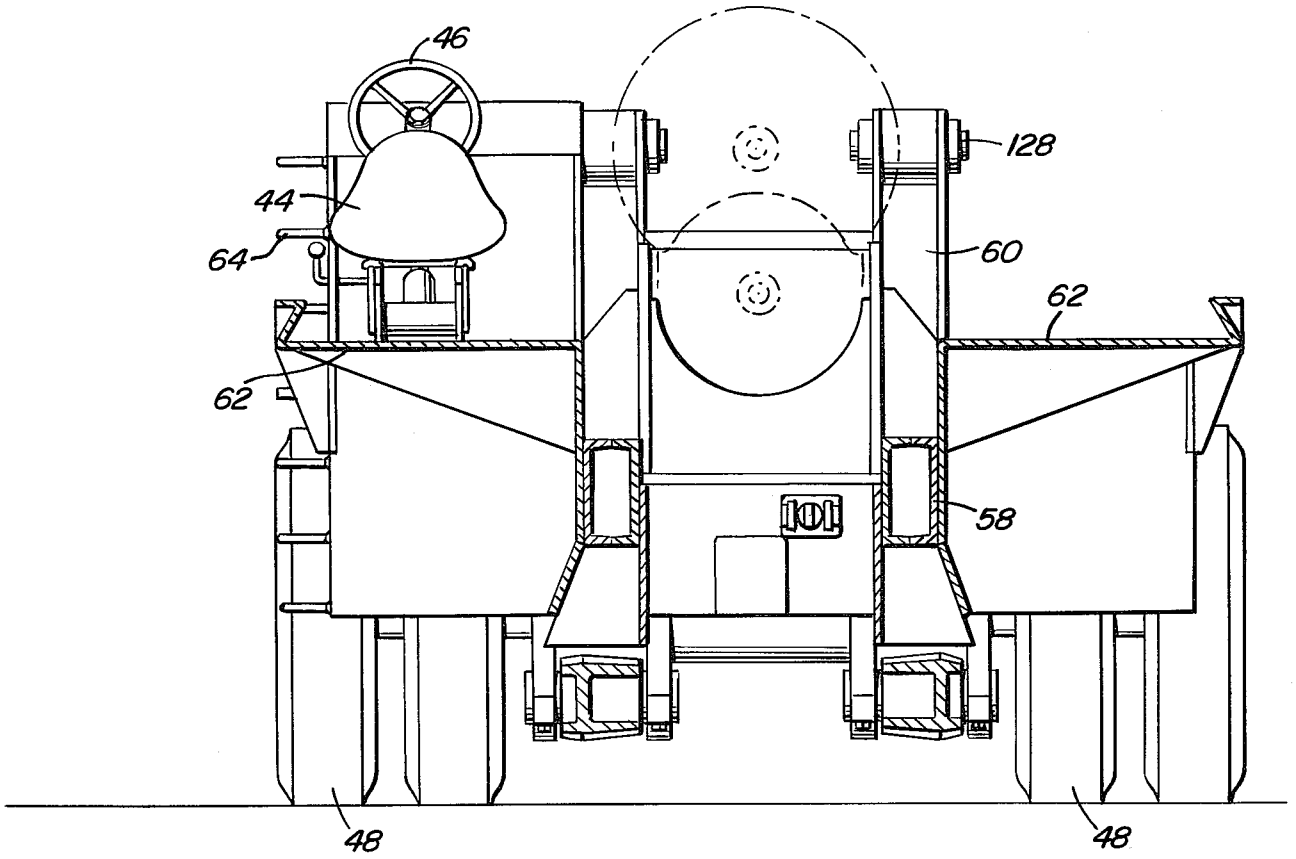
FIG. 6 is a transverse, sectional view of the machine illustrating some of the structural details thereof.

Referring now to the drawings, the earth working machine of the present invention is generally designated by the numeral 30 and includes a self-propelled, wheeled vehicle generally designated by numeral 32, a longitudinally extending conveyor generally designated by numeral 34, a transverse conveyor generally designated by numeral 36 located rigidly at the rearward end portion of the longitudinal conveyor 34, an earth working or handling implement generally designated by numeral 38 at the forward end of the longitudinal conveyor 34 and a subframe generally designated by numeral 40 which interconnects the vehicle 32 and the forward end portion of the longitudinal conveyor 34 to elevate the forward end portion of the conveyor from the position illustrated in FIG. 1 to the position illustrated in FIG. 2. The vehicle 32 includes a prime mover 42 which may be in the form of a suitable internal combustion engine located rearwardly of an operator's seat 44 which is associated with a control station including a steering wheel 46, and the like. The vehicle 32 also includes ground engaging drive wheels 48 generally located below the prime mover 42 and forward steerable and drive wheels 50. Located rearwardly on the vehicle 32 is a grader blade 54 supported by a turntable or circle 56 for manipulation in a conventional manner such as disclosed in the aforementioned prior U.S. Pat. No. 2,855,116, the disclosure of which is incorporated herein by reference thereto. As illustrated in FIG. 6, the vehicle includes supporting frame rails 58 and upstanding support structures 60 disposed centrally of the vehicle with the operator's seat and control station being oriented at one side thereof and laterally extending panel members 62 at each side of the upstanding support members 60 to provide supporting surfaces on the vehicle. A suitable ladder structure 64 is provided at the operator's side of the vehicle to enable access to be gained to the operator's seat 44.

Figure 7:
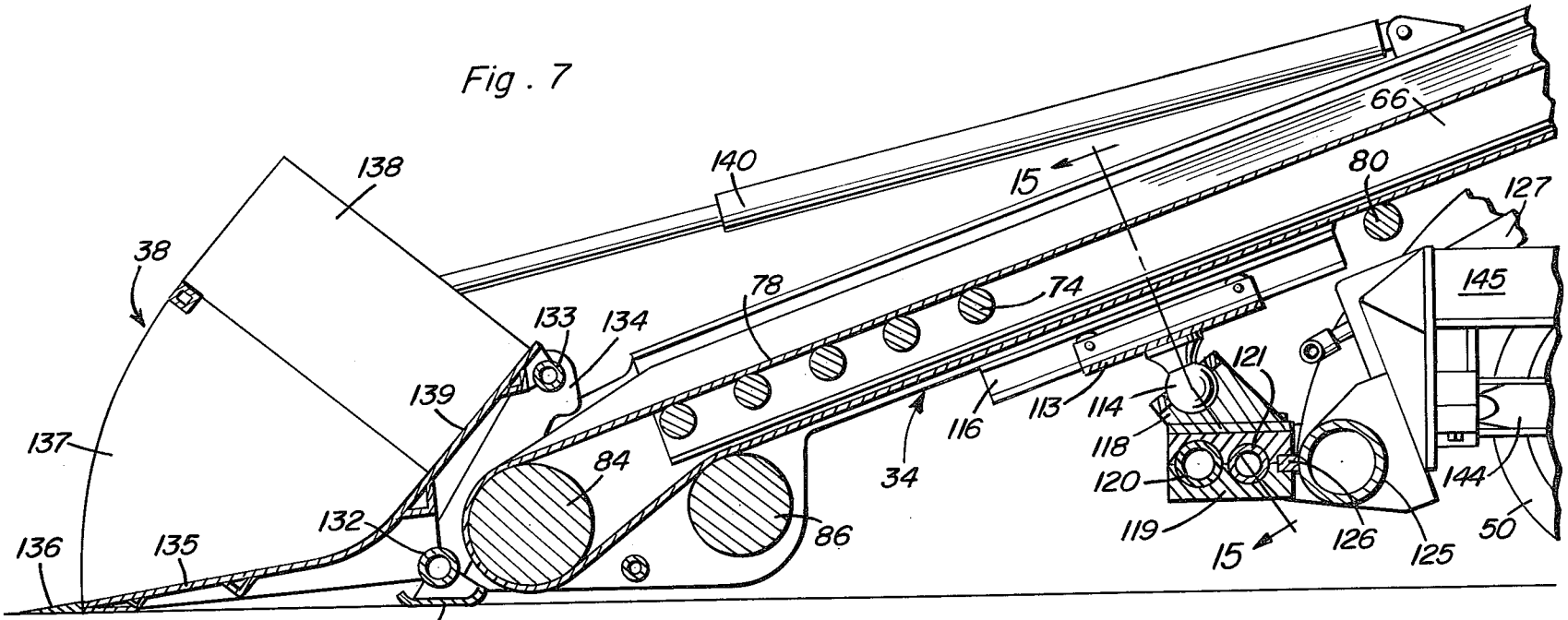
FIG. 7 is a longitudinal, sectional view of the forward end portion of the longitudinal conveyor taken substantially upon a plane passing along section line 7—7 of FIG. 3.
Figure 9:
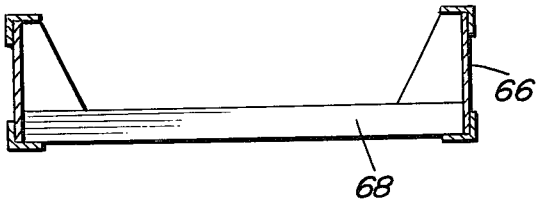
FIG. 9 is a transverse, sectional view of the supporting frame work for the longitudinal conveyor.
Figure 8:
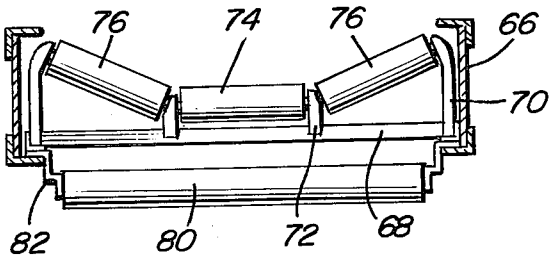
FIG. 8 is a transverse, sectional view of the longitudinal conveyor with the conveyor belt removed.
Figure 12:
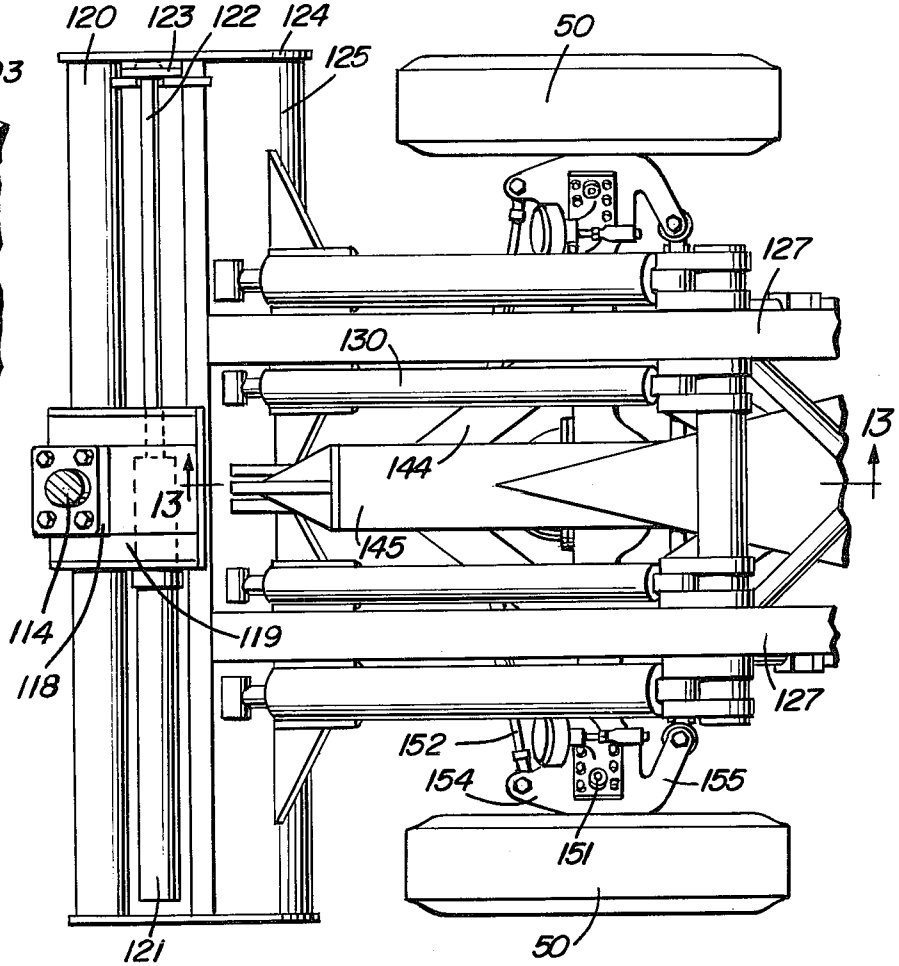
FIG. 12 is a plan view of the forward end portion of the vehicle and subframe taken substantially along section line 12—12 of FIG. 1 illustrating the lateral adjustment and the vertical swinging capability of the subframe.

The longitudinal conveyor 34 includes a pair of longitudinally extending frame rails 66 interconnected by transverse extending members 68. Upwardly extending brackets 70 and 72 are provided on the frame rails 66 and supporting structures 68 to support a plurality of rollers 74 and 76 with the rollers 74 being generally horizontally disposed and the rollers 76 being upwardly and outwardly inclined for providing a supporting and guiding structure for an elongated endless conveyor belt 78 which has the upper run thereof supported by the plurality of sets of rollers 74 and 76 which are spaced longitudinally of the longitudinal conveyor for provding a support for the conveyor belt 78 in a well known manner. The return run of the belt 78 extends over and is supported by an underlying roller 80 supported from the frame rails 66 of the conveyor by brackets 82, as illustrated in FIG. 8. The forward end of the conveyor is provided with a large roller 84 which forms a radius of flexing of the belt 78 and an underlying large roller 86 is spaced therefrom to engage the undersurface of the return flight of the conveyor belt 78, as illustrated in FIG. 7 thereby providing guiding support for the conveyor belt 78 at the forward end portion of the conveyor 34.

Figure 10:
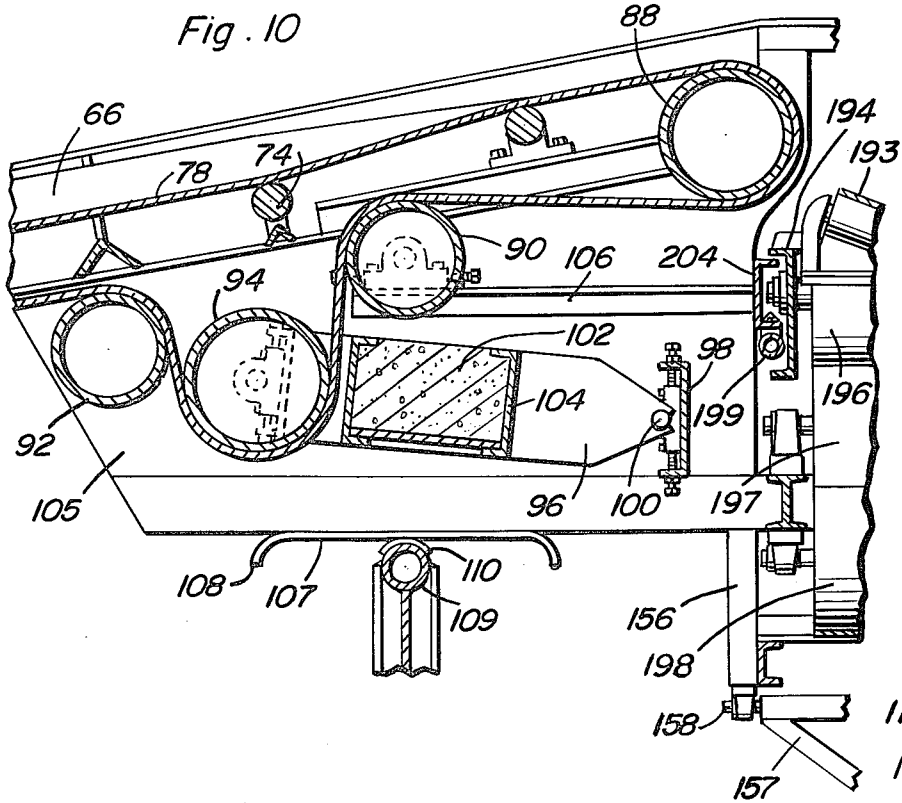
FIG. 10 is a longitudinal, sectional view of the rearward end portion of the longitudinal conveyor taken substantially upon a plane passing along section line 10—10 of FIG. 4.

FIG. 10 illustrates the rearward end portion of the conveyor 34 and includes an endmost roller 88 and a pair of spaced rollers 90 and 92 engaging the return run of the belt 78 with the rollers 90 and 92 being spaced apart and a tensioning roller 94 engages the interior of the return run or flight of the belt 78 between the rollers 90 and 92 to bias this portion of the belt 78 downwardly. The tensioning roller 94 is supported by an elongated bracket 96 pivotally supported from the rear end portion of the conveyor by a bracket 98 and a pivot axle or shaft 100 so that a weight 102 supported from the bracket 96 will exert a downward force on the roller 94 thereby tensioning the belt 78 but yet enabling the belt 78 to elongate if necessary, since the roller 94 is free-floating about the pivot axle 100 with the weight 102 preferably being in the form of a block of concrete or other heavy material. The block of concrete may be poured into and hardened into a supporting container 104 therefor or the weight 102 may be removable and interchangeable with other weights to enable the tension on the conveyor belt 78 to be maintained at a desired level so that the conveyor belt 78 may be driven in a linear manner as is conventional and well known. The supporting frame work for the conveyor 34 is reinforced with gussets or transverse members and may be constructed of various standard structural components providing sufficient rigidity to enable the longitudinal conveyor to handle relatively heavy loads of soil, earth, or other similar material, with the inclined rollers serving to provide a trough-like transverse configuration to the conveyor belt so that the quantity of material capable of being conveyed by the conveyor belt will be at a maximum.

Figure 21:
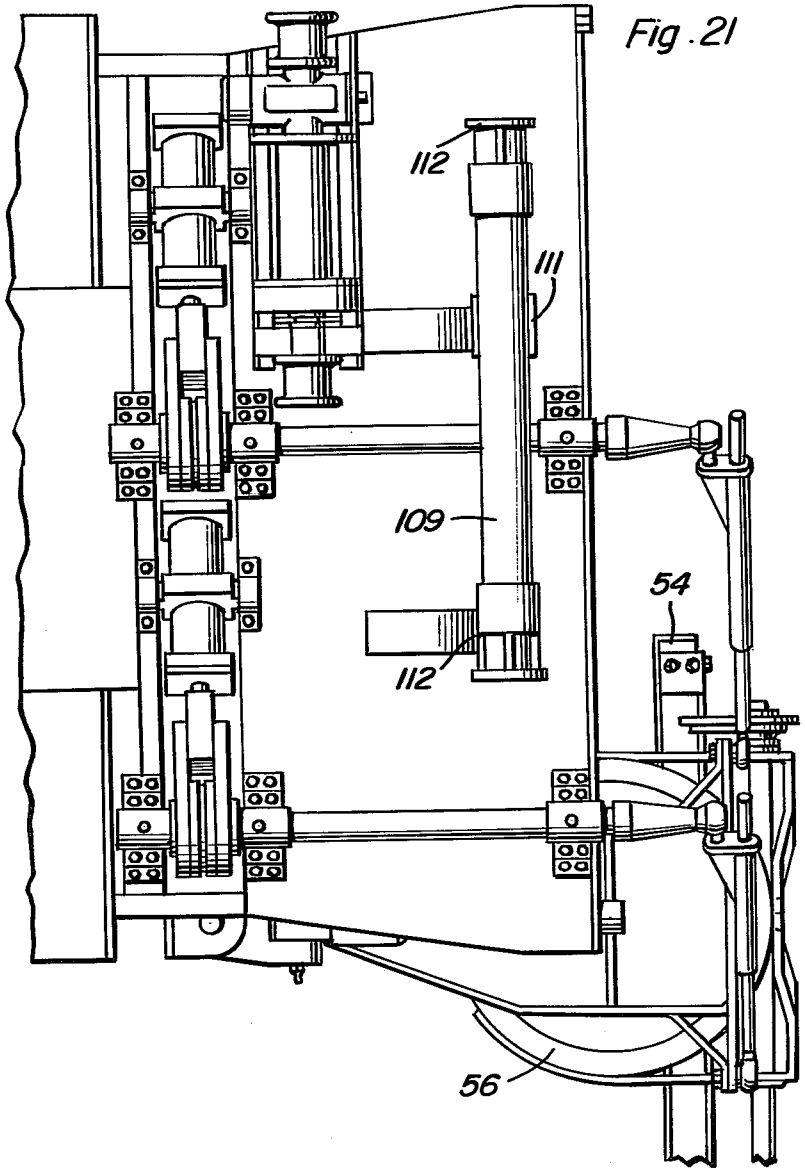
FIG. 21 is a fragmental plan view of a portion of the supporting structure at the rear of the machine taken generally along reference line 21—21 on FIG. 1.

The rearward end portion of the longitudinal conveyor 34 is provided with rigid depending side plates 105 which journal the rollers 90 and 92 with the plates 105 being reinforced by structural members 106. Extending transversely at the lower edges of the plates 106 is a supporting plate 107 having downturned forward and rearward edges 108 for engagement with a transverse supporting bar or shaft 109 having a wear surface 110 thereon. The transverse supporting rod 109 is supported between upstanding support members 111 rigidly affixed to the rearward end portion of the vehicle, as illustrated in FIGS. 10 and 21, with the outer ends of the support member 109 including upstanding retaining members 112 suitably reinforced by gussets, or the like, in order to provide an upwardly facing support surface for the rearward end of the conveyor 34 to constrain the rearward end of the conveyor 34 from moving downwardly or laterally but permitting the conveyor 34 to move upwardly off of the supporting member 109 to the position illustrated in FIG. 2.

The forward end portion of the conveyor 34 is supported from the forward end of the subframe 40 with the connection therebetween including a longitudinally movable plate 113 having a spherical ball 114 rigid therewith and depending downwardly therefrom. The plate 113 is provided with corner rollers 115 which are movably supported in longitudinal channel-shaped trackways 116 attached to the side rails 66 of the longitudinal conveyor by brackets 117 so that the trackways or guides 116 are rigidly secured to the longitudinal conveyor and the plate 113 is capable of longitudinal movement in relation thereto so that as the forward end of the longitudinal conveyor 34 swings from a lowered position, illustrated in FIGS. 1 and 7, to an elevated position, illustrated in FIG. 2, the plate 113 and the ball connector 114 rigid therewith may move longitudinally in relation to the longitudinal conveyor 34.

The ball connector 114 is received in a socket 118 which enable universal movement between the ball 114 and the socket 118. The socket 118 is mounted fixedly on a supporting block 119 which is slidably mounted on a transverse support member 120 and also connected to a cylinder 121 which is movable on a stationary rod 122 affixed to a bracket 123 rigid with a pair of side rails 124 defining the forward end portion of the subframe 40. A transverse support member 125 which includes a bracket 126 engaged with the supporting block 119, as illustrated in FIG. 7, provides a support structure for the socket 118. The side members 124 are secured to side rails 127 of the subframe 40 and the rearward ends of the side rails 127 are journaled from support members 60 on the vehicle by pivot assemblies 128 for vertical swinging movement about a transverse axis with hydraulically actuated piston and cylinder assemblies 129 interconnecting the vehicle 32 and the subframe rails 127, as illustrated in FIG. 2, in order to move the subframe 40 in a vertical swinging manner about the axis defined by the pivot assemblies 128. Also, the angular orientation of the side members 124 and the position of the mounting block 119 and related structure may be varied by a piston and cylinder assembly 130 interconnecting the rails 127 and a lateral extension on the members 124 so that the entire forward assembly may be pivoted for accurate control thereof about a substantially transverse axis. The socket 118 is provided with a mechanism for releasing the ball 114 therefrom to enable detachment of the longitudinal conveyor 34 and attachment of other implements. The rod 122 includes a piston thereon received in cylinder 121 thus forming a double-acting piston and cylinder assembly so that by communication of hydraulic fluid with selected ends of the cylinder 121, the mounting block 119 may be moved laterally of the guide member 120 within the limits of the movement of the cylinder 121 on the rod 122 having a piston thereon. Thus, the supporting assembly at the forward end of the subframe may be swung vertically along with the subframe, moved laterally and swung about a transverse axis at the forward end of the subframe with this movement being controlled from the operator's station by a suitable valve structure associated with a source of hydraulic pressure, which is a well known and conventional technique in controlling movement of machines of this type.

Figure 3:
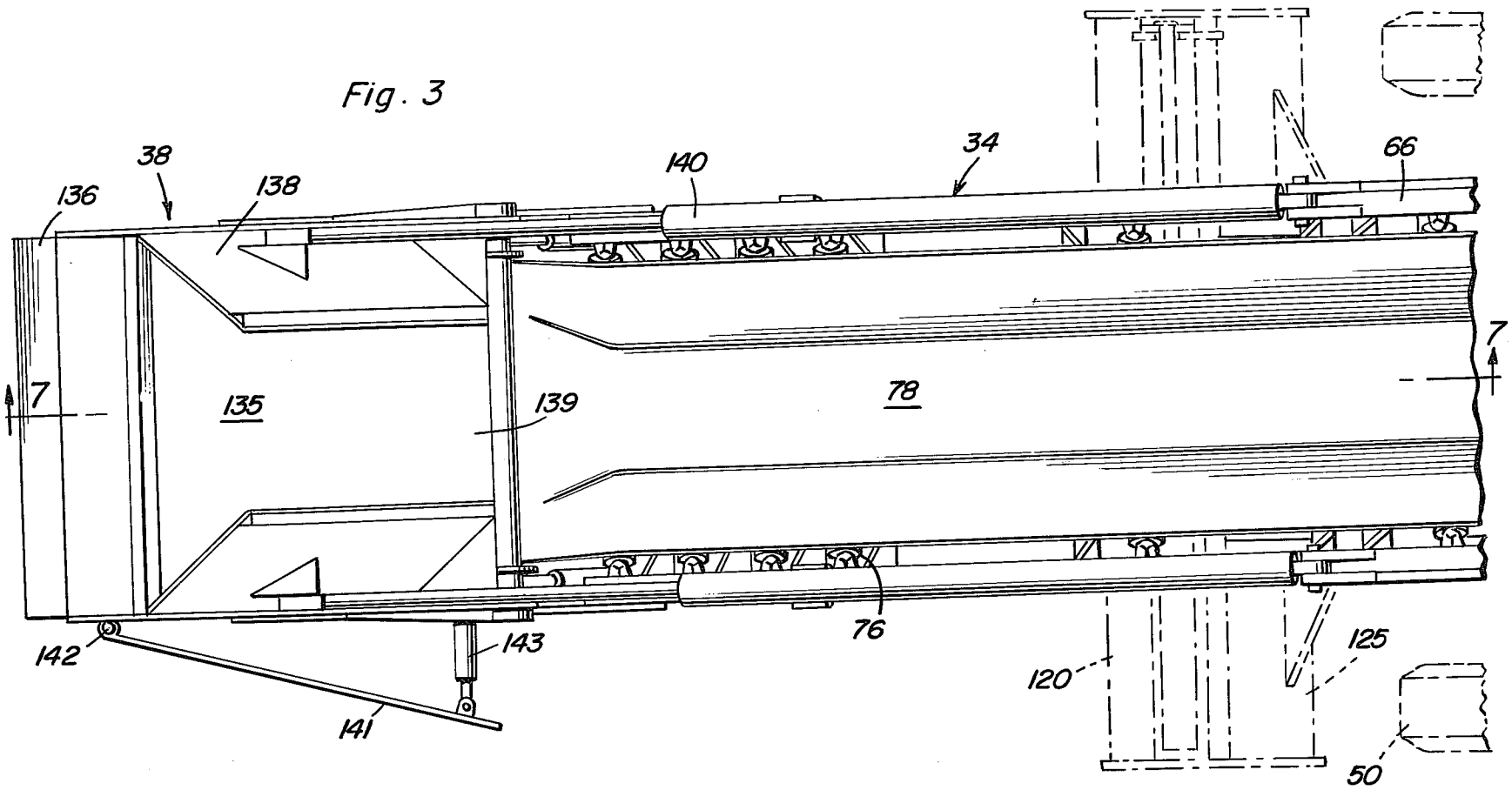
FIG. 3 is a fragmental, top plan view of the forward end portion of the longitudinal conveyor.

The forward end of the longitudinal conveyor includes a transverse skid 131 to limit the movement thereof toward the ground surface and a transverse stop member 132 which limits the downward pivotal movement of the implement 38 about a supporting shaft or rod 133 supported from side plates 134 on the forward end of the conveyor 34. The implement 38 includes a bottom wall 135 having a wedge-shaped forward edge 136 for scooping dirt into the interior of the bucket-like implement and between the side walls 137 which terminate in inwardly converging upper end portions 138 so that material will be confined in a relatively narrow area for discharge onto the conveyor belt 78 from the upper and rearward end 139 of the bottom wall 135. The pivotal position of the implement 38 about the pivot axis 133 is controlled by a piston and cylinder assembly 140 extending from the longitudinal conveyor to the side walls of the implement, as illustrated in FIG. 3. Also, the implement 38 is provided with a landside plate 141 pivoted to the forward end portion of the side wall 134 for movement about a vertical axis, as indicated by numeral 142. A piston and cylinder assembly 143 interconnects the rearward end of the landside or plate 141 with the implement in order to vary the angular position thereof so that the longitudinal path of the forward end 136 of the implement may be guided in relation to a vertical bank, or the like, which can be engaged by the landside 141 to prevent the forward end of the conveyor 34 from digging into the vertical surface of a bank, or the like.

Figure 14:
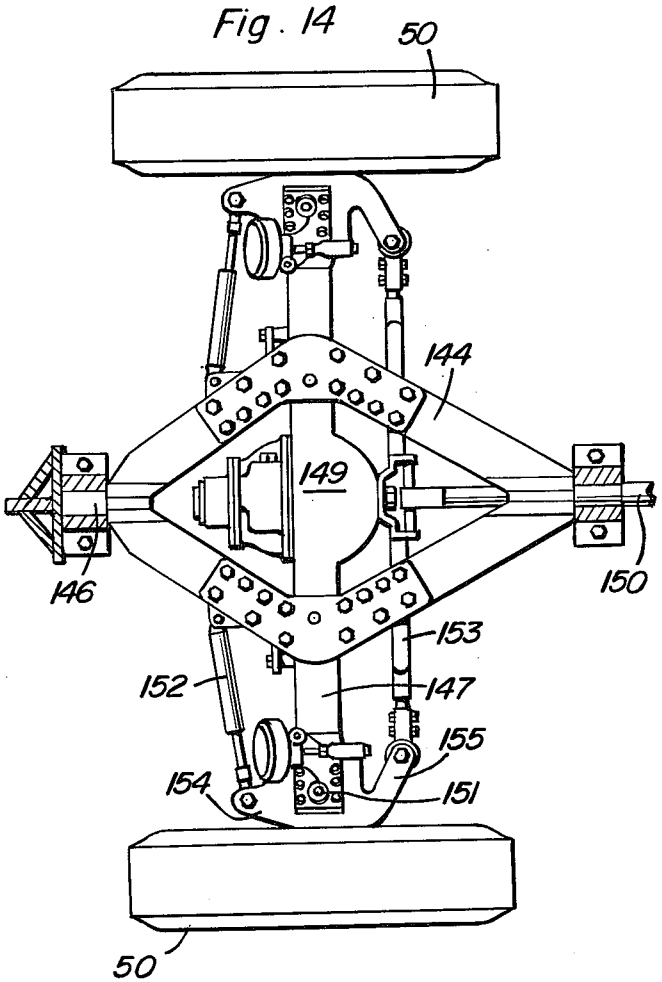
FIG. 14 is a detailed plan view of the steering and support mechanism for the forward wheels of the machine.
Figure 13:
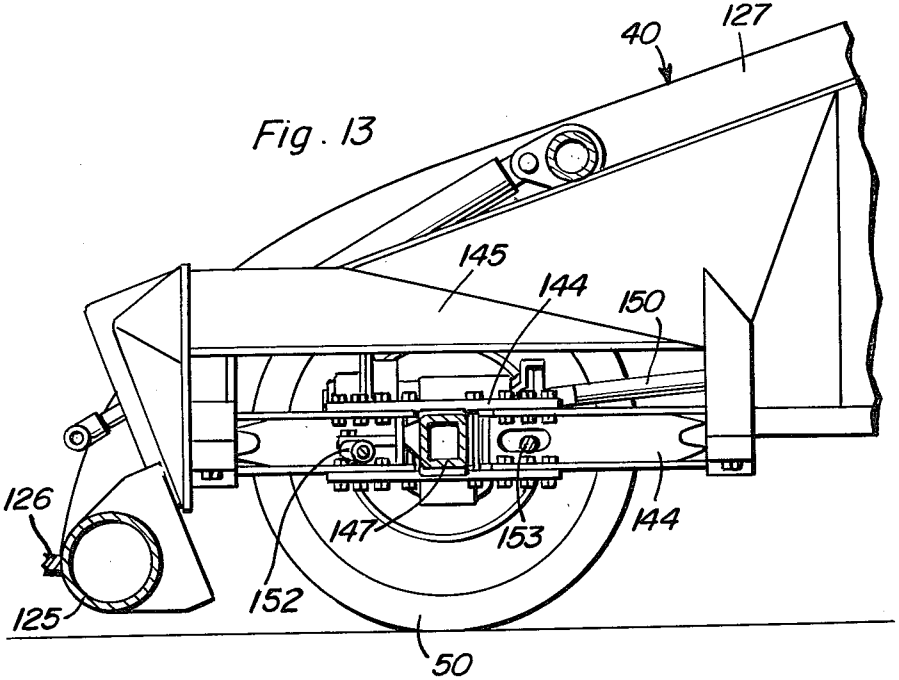
FIG. 13 is a longitudinal, sectional view taken substantially upon a plane passing along section line 13—13 of FIG. 12 illustrating further structural details of the forward end of the machine.
Figure 15:
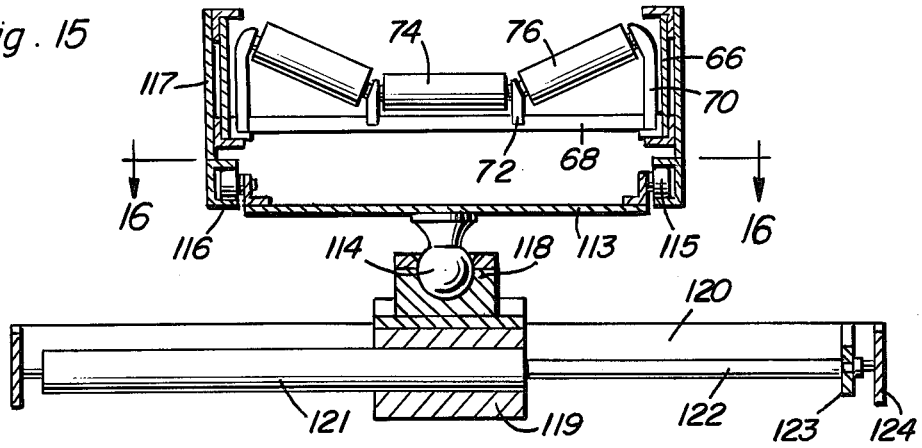
FIG. 15 is a transverse, sectional view taken substantially upon a plane passing along section line 15—15 of FIG. 7 illustrating further structural details of the forward, laterally adjustable, universal support for the forward end portion of the longitudinal conveyor.
Figure 16:
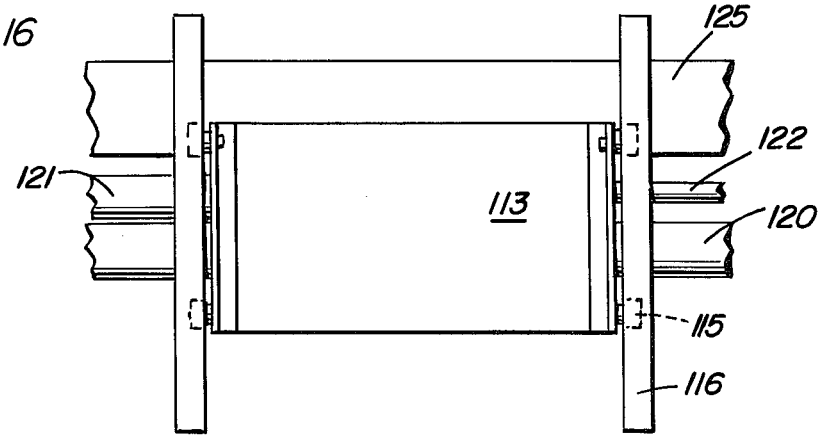
FIG. 16 is a detailed sectional view taken substantially along section line 16—16 of FIG. 15 illustrating further structural details of the supporting device for the forward end portion of the longitudinal conveyor.

FIGS. 13 and 14 illustrate the details of the steerable and driven wheels 50 which include a frame structure 144 supported from depending supporting frame work 145 for pivotal movement about a longitudinal axis 146 which enables the frame 144 to oscillate about a longitudinal axis. Supported from the frame 144 is an axle housing 147 including a differential housing 149 into which a power shaft 150 extends for driving the wheels 50 in a well known manner. The wheels 50 are pivotal about vertical axes defined by king pins, or the like, 151 with hydraulic piston and cylinder assemblies 152 being provided for power steering the wheels 50. A tie rod of drag link 153 also interconnects the wheels 50 to each other to maintain them in parallel in a well known manner with the power steering assembly and the tie rod or drag link assembly being connected to forward and rearward arms 154 and 155, respectively, associated with the wheel in order to steerably control the wheels 50. The specific details of the drive system and suspension system for the forward wheels 50 and the rear driven wheels 48 are not illustrated in detail since these components including brakes, and the like, are conventional and may be of standard structural arrangements.

Various types of implements may be utilized on the forward end of the conveyor 34 including scoop-like implements, powered implements, and the like, which enables the dirt or other material to be gathered at any desired elevational position in relation to the vehicle within the limits of the vertical swinging movement of the forward end of the conveyor 34. Also, the conveyor 34 may be removed from the machine by disconnecting the ball and socket connection between the ball 114 and the socket 118, since the rearward end portion of the conveyor is not attached to the machine, but merely supported thereon, thus facilitating quick removal of the conveyor 34 to enable other implements to be attached to the forward end portion of the subframe in a manner described hereinafter.

The rearward end portion of the longitudinal conveyor 34 is rigidly attached to the transverse conveyor 36 which includes a vertical frame work 156 having a pair of vertical supporting legs 157 hinged to the rearward corners thereof at 158 with supporting wheels 159 being journaled from the lower end of the legs 157. Each of the legs 157 is connected to an angularly disposed piston and cylinder assembly 160 anchored to a stationary portion of the transverse conveyor 36 so that the wheels 159 may be positioned in the downwardly disposed operative position illustrated in FIG. 5 and a retracted or inoperative position illustrated in broken line in FIG. 5. Thus, when it is desired to disconnect the longitudnal conveyor 34, it is only necessary to lower the wheels 159 and elevate the forward end portion of the conveyor 34 so that the wheels 159 will support the rearward portion of the conveyor assembly so that an elevated supporting surface may be utilized to support the forward end portion of the longitudinal conveyor 34 thereby enabling the ball and socket connection to be disconnected for enabling the vehicle to be utilized without the longitudinal and transverse conveyor assembly attached thereto so that other implements may be attached to the forward end of the subframe.

Figure 18:
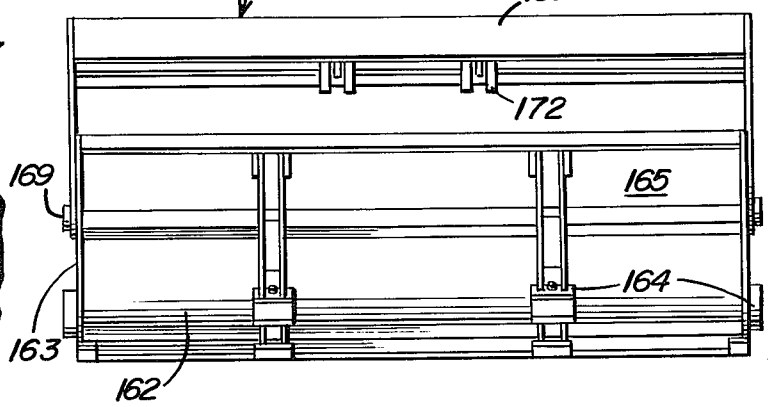
FIG. 18 is an elevational view of the rearward end of the front end loader illustrated in FIG. 17.
Figure 17:
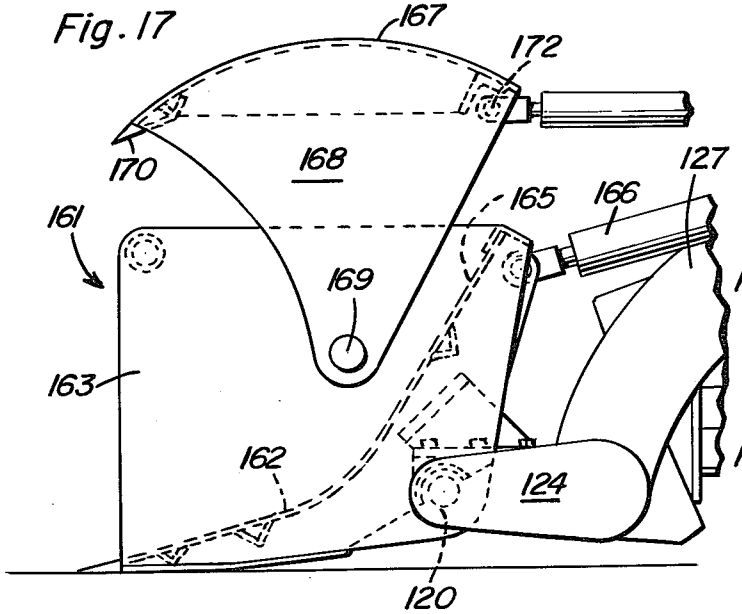
FIG. 17 is a side elevational view of a front end loader-type of attachment for the forward end of the machine.

One such interchangeable implement is illustrated in FIGS. 17 and 18 and is designated generally by reference numeral 161 and is in the form of a scoop-like member having a bottom wall 162 and side walls 163 rigid therewith, with the side walls 163 being connected to the transverse support member 120 by bracket structures 164 rigid with the rear wall 165 of the scoop-like bucket which is a continuation of the bottom wall 162. A piston and cylinder assembly 166 enables pivotal movement of the implement 161 about the axis defined by the transverse member 120 and the combination of the bottom wall 162 and the rearward wall 165 enables the device to be used in the manner of a front end loader. A closure plate 167 is provided for the forward portion of the implement 166 with the closure plate including side walls 168 of generally triangular configuration hingedly attached to the side walls 163 for movement about hinge axis 169. The forward lower edge of the plate 167 is provided with the wedge-shaped projection 170 to cooperate with the wedge-shaped forward edge of the bottom wall 162 to retain soil in the implement 161. A piston and cylinder assembly 171 is connected to the closure plate or door 167 to enable it to be moved from an open to a closed position with the piston and cylinder being connected to supporting brackets or lugs 172 on the closure plate 167.

Figure 20:
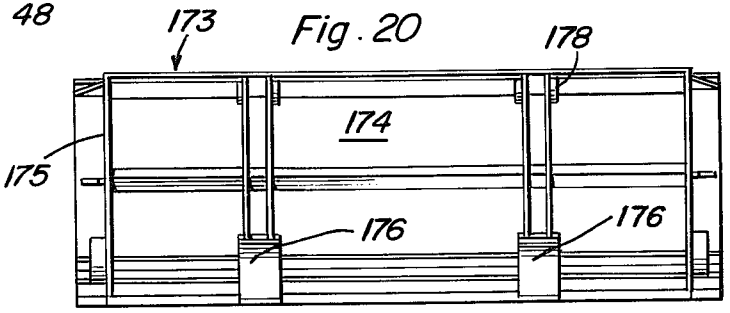
FIG. 20 is a rear elevational view of the blade of FIG. 19.
Figure 19:
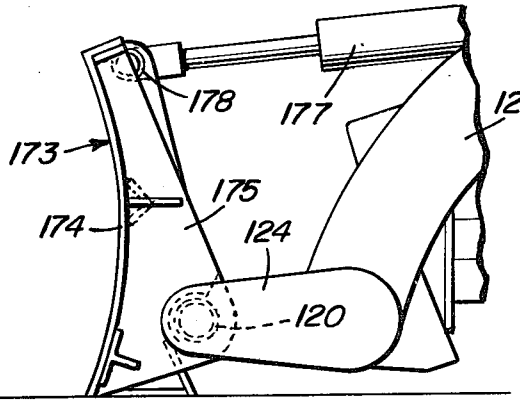
FIG. 19 is a fragmental elevational view illustrating a bulldozer-type blade mounted at the forward end of the machine.

FIGS. 19 and 20 illustrate another type of implement attachable to the forward end portion of the subframe 40 which is generally designated by numeral 173 and includes a verticlly disposed arcuate blade 174 similar to a bulldozer blade having rearwardly extending side plates 175 rigid therewith attached to the transverse support member 120 by bracket structures 176. The upper end portion of the implement 173 is connected to a piston and cylinder assembly 177 by use of bracket lugs 178 whereby the vertical angular position of the blade 174 may be pivoted about a transverse axis in a well known manner, so that the machine may be utilized somewhat in the nature of a bulldozer with a forward blade having adequate reinforcement for various purposes.

Figure 24:
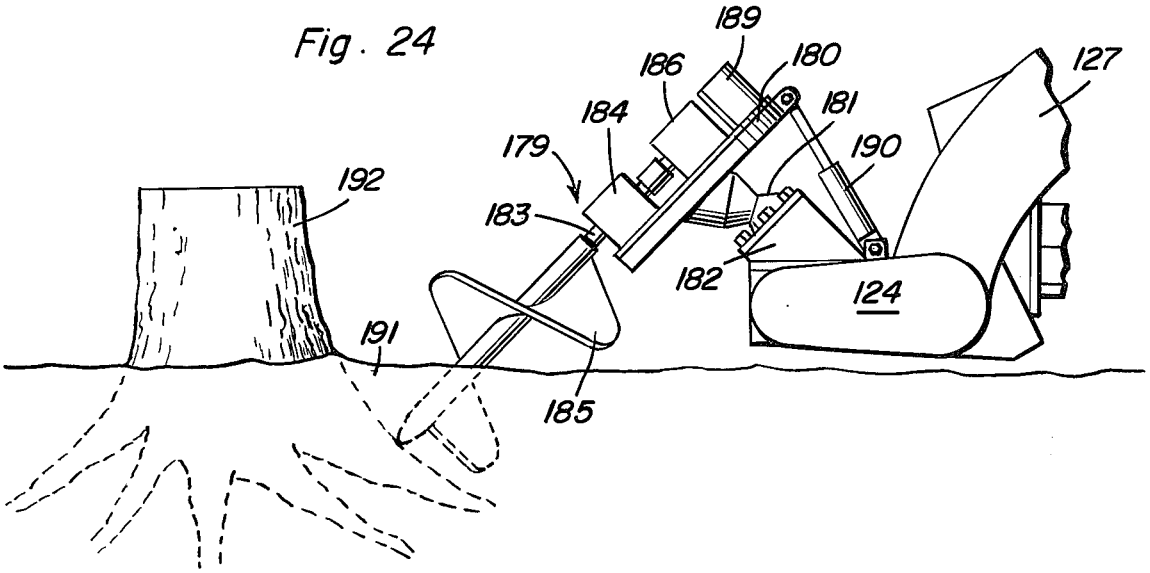
FIG. 24 is a side elevational view of the auger illustrating one manner of use thereof.
Figure 22:
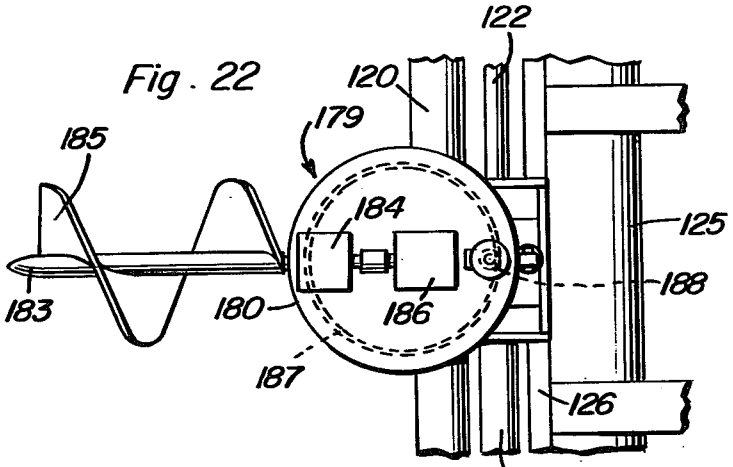
FIG. 22 is a top plan view of an auger device mounted on the forward end of the machine.
Figure 23:
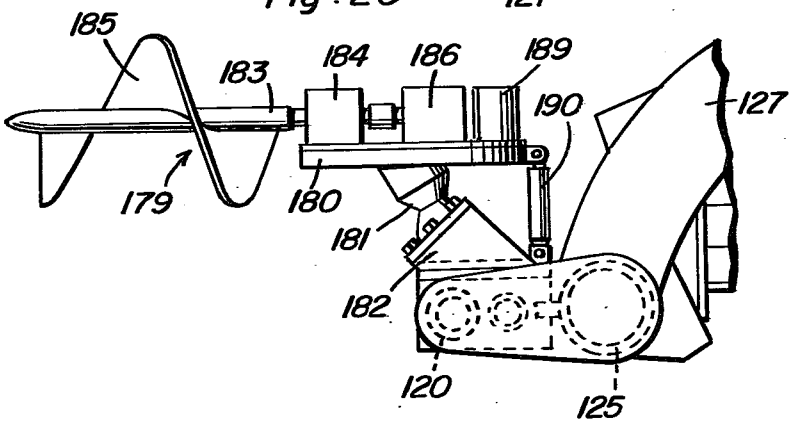
FIG. 23 is a side elevational view thereof.

FIGS. 22–24 illustrate another type of implement in the form of a driven auger generally designated by reference numeral 179 and which includes a supporting plate 180 having a ball-type connector 181 thereon for reception in and mounting on a modified socket 182. The plate 180 includes an auger shaft 183 journaled in a suitable bearing structure 184 and provided with an auger flight 185 thereon. The auger shaft 183 is driven from a suitable motor 186 which may be a hydraulic operated motor, or the like, so that torque may be applied to the shaft 183 for rotating the auger. The plate 180 is circular in configuration and provided with an internal ring gear 187 engaged with a pinion gear 188 driven from a vertical motor 189, or the like, so that the angular position of the auger about a vertical axis may be varied and the plate 180 may be pivoted about a transverse axis by a piston and cylinder assembly 190. If desirable, rather than a universal ball and socket connection, the connection with the forward end of the subframe may be constrained to only a pivotal movement about a transverse axis. This structure enables the auger 186 to be oriented in various positions for drilling into the earth, or the like. For example, as illustrated in FIG. 24, the auger flight 185 may be utilized to drill a hole in the soil 191 adjacent a stump 192, or the like, in order to facilitate removal of the stump, such as when clearing land, or the like. By mounting the implement 179 on the transverse support 120 and connecting it with the cylinder 121 and piston rod 122, the auger may also be moved laterally in relation to the subframe.

The transverse conveyor 36 includes an endless conveyor belt 193 supported in the same manner as the belt 178 from side rails 194 and journaled over end rollers 196 in a conventional manner. The belt on its return pass extends around idler rollers 197 and under a tension roller 198. This entire assembly is laterally movable or shiftable so that the transverse conveyor 36 may be extended to either side of the longitudinal conveyor, as illustrated in broken line in FIG. 5, with a cylinder 199 being provided for this purpose and connected to a piston rod 200 having a piston thereon received in the cylinder so that by admitting fluid to opposite sides of the piston, the transverse conveyor may be laterally adjusted. The transverse conveyor belt may be driven by a suitable drive assembly generally designated by numeral 201 and the longitudinal conveyor belt 78 may be driven by a suitable adjustable drive mechanism 202, as illustrated in FIG. 2. The specific details of the drive mechanisms for the conveyors may be varied as may the drive mechanisms for the other components of the machine, with it being pointed out that such drive mechanisms may be mechanical or hydraulic. As illustrated in FIG. 2, with the implement 38 retracted and the conveyor 34 elevated at its forward end, the supporting wheels 159 elevate the rearward end of the conveyor assembly away from the machine so that by supporting the forward end of the longitudinal conveyor 34 in an elevated position, the connection between the subframe 40 and the longitudinal conveyor 34 may be disengaged, thus enabling the machine to be used for other multiple purposes.

Figure 4:
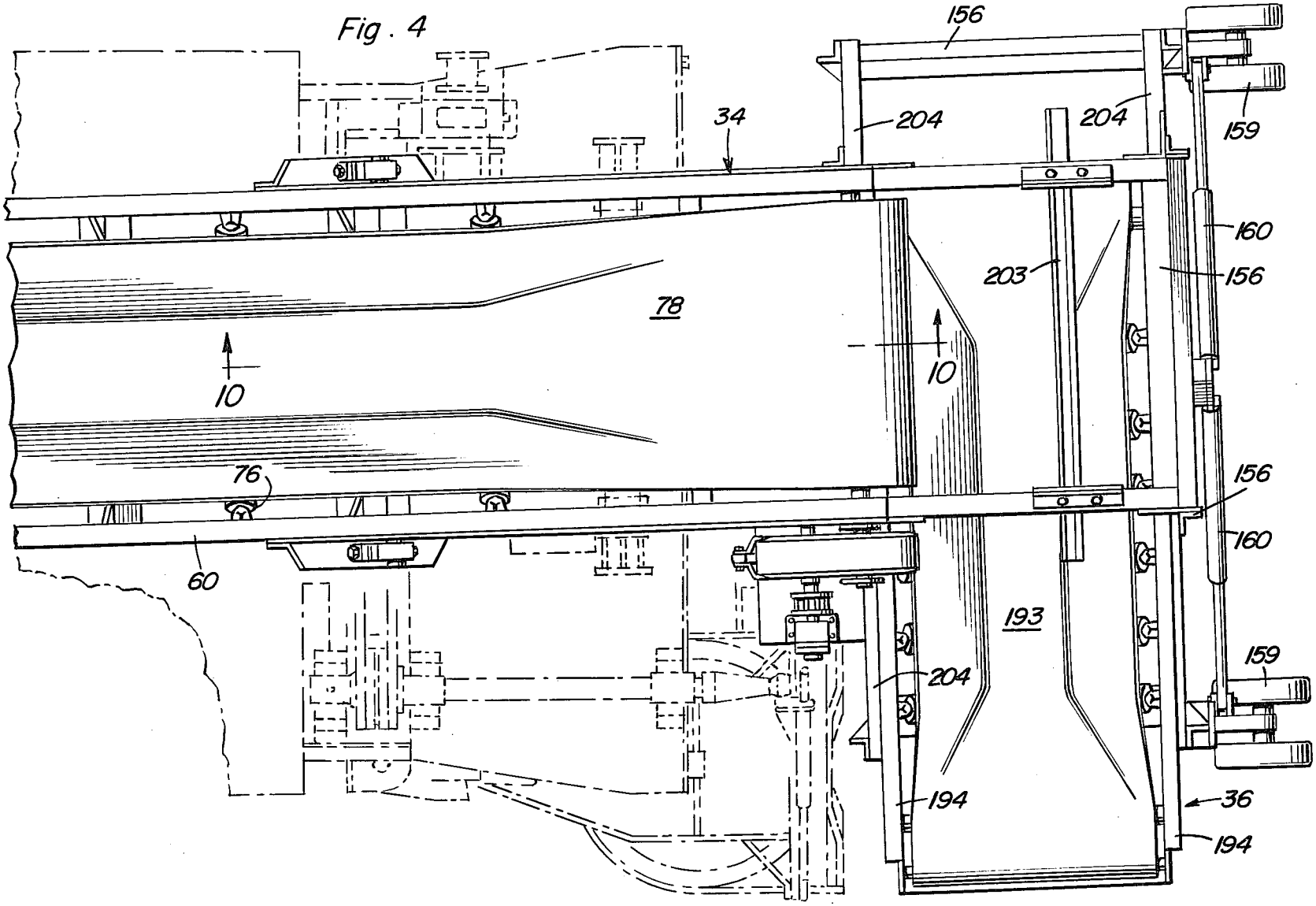
FIG. 4 is a fragmental, top plan view of the rearward end portion of the longitudinal conveyor and the transverse conveyor associated therewith.
Figure 5:
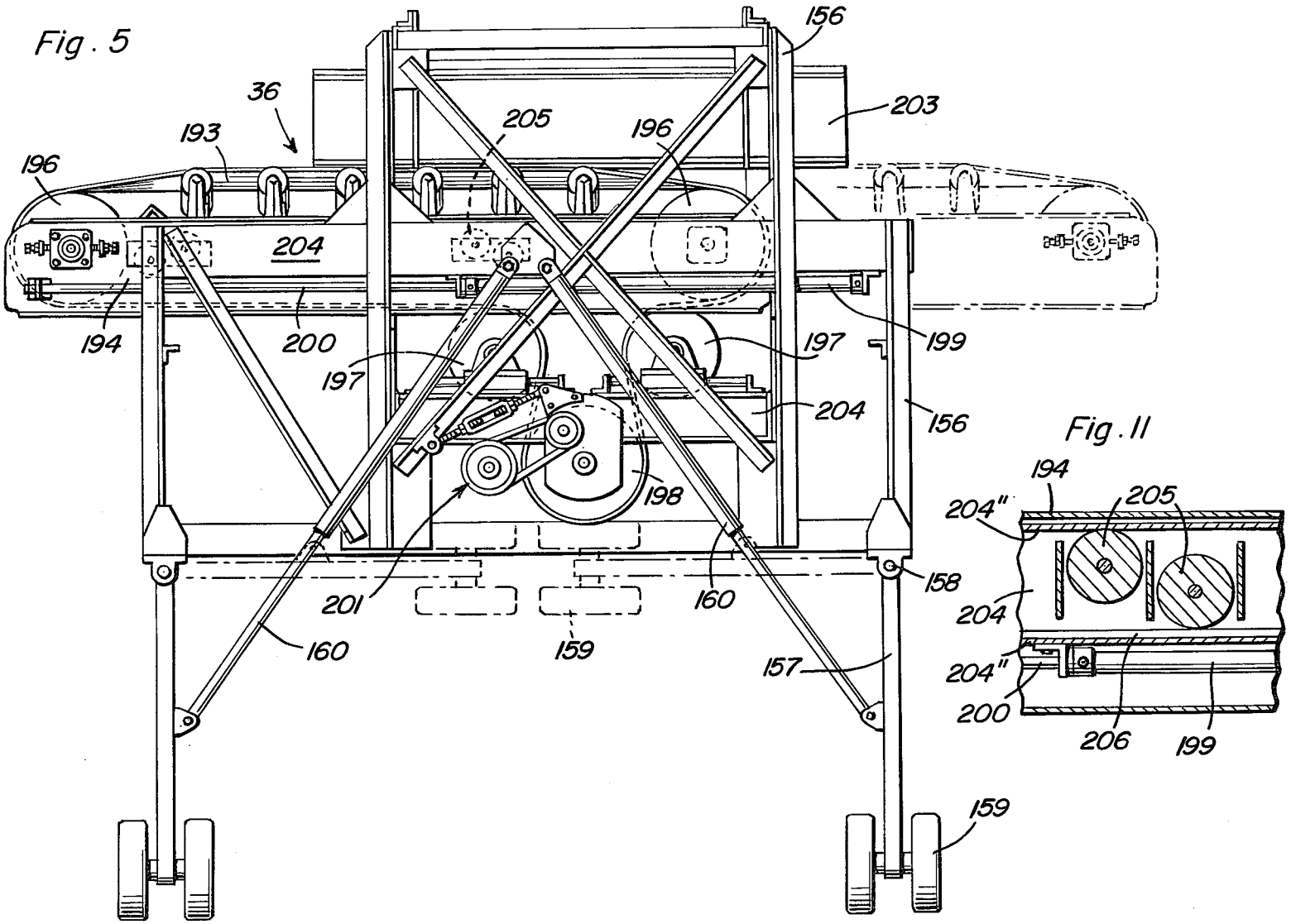
FIG. 5 is a rear elevational view of the transverse conveyor.

Extending transversely of the discharge end or rearward end of the longitudinal conveyor 34 is a downwardly curved deflector 203 to make certain that any material discharged from the rearward end of the longitudinal conveyor belt 78 will be deposited on the transverse conveyor belt 193. The relationship of the deflector 203 to the longitudinal conveyor belt 78 and the transverse conveyor belt 193 is best illustrated in FIGS. 4 and 5. As illustrated in FIG. 5, the movable piston rod 200 is connected with the frame work or rails 194 of the transverse conveyor in a manner to move the belt 193, supporting rollers and rails 194 transversely with such movement being supported and guided by transverse rail members 204 stationary with respect to the longitudinal conveyor and which may conveniently be in the form of horizontally disposed trackways with the frame work 156 also being rigid with the rails 204 and also being rigid with respect to the longitudinal conveyor so that only the transverse conveyor moves transversely when fluid pressure is admitted and exhausted to opposite ends of the cylinder 199

FIG. 11 illustrated the details of the supporting relationship between the side walls 194 of the transverse conveyor and the guide rails 204 and the supporting rollers 205 which support the rails 194 from the guide rails or tracks 204. As illustrated in FIG. 10, the vertical dimension of the side rails 194 is substantially more than the stationary guide rails 204 and the rollers 205 are arranged in pairs with one of each of the rollers 205 engaging the lower surface of the upper flange 204' and the lower roller engaging an inverted V-shaped track or rail supported on the lower flange 204". The piston and cylinder assembly 199, 200 is disposed between the lower flange 204" of the rail 204 and the bottom flange of the rail 194, as illustrated in FIGS. 10 and 11. Thus, by providing a plurality of sets of rollers 205, the transverse conveyor 36 will be stabilized in relation to the stationary frame regardless of its transverse position in relation to the longitudinal conveyor.

As previously indicated, the wheeled vehicle generally designated by numeral 32 is somewhat similar to that disclosed in my U.S. Pat. No. 2,855,116 and although not specifically disclosed in this application, the front steerable wheels 50 are tiltable about longitudinal axes in a manner well known in conventional road graders and the structure for this purpose may be the same as that illustrated in the aforementioned prior patent.

The foregoing is considered as illustrative only of the principles of the invention. Further, since numerus modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An earth working machine comprising a mobile frame, a longitudinally extending conveyor supported from said frame, a transverse conveyor suported from the rearward end of said frame and being rigid with respect to the longitudinal conveyor, and an earth engaging means mounted on the forward end of the longitudinal conveyor for depositing earth, or the like, onto the longitudinal conveyor for movement rearwardly on the longitudinal conveyor onto the transverse conveyor for movement laterally of the machine, each of said conveyors including an endless belt supported by rollers defining the upper flight of the belt into a trough-like configuration, said longitudinal conveyor including means thereon supportingly engaging the frame at longitudinally spaced points with the rearward support means being in the form of a downwardly facing plate engaging a support surface on the frame in a manner to permit free upward movement of the rearward end portion of the longitudinal conveyor in relation to the frame, the forward support means including subframe interconnecting the longitudinal conveyor and the frame for vertical swinging movement to raise and lower the forward end portion of the longitudinal conveyor, said subframe including a laterally movable detachably engaged connecting means engaged with the longitudinal conveyor to enable vertical elevation of the forward end portion of the longitudinal conveyor and detachment of the longitudinal conveyor from the subframe thereby enabling the longitudinal conveyor to be readily disengaged from the subframe and frame to enable the mobile frame and subframe to be utilized for multiple purposes.

2. The structure as defined in claim 1 wherein said connecting means between the subframe and longitudinal conveyor includes a ball and socket connection, said socket being mounted on the subframe and supported on a transversely elongated supporting and guiding surface, and power means interconnecting the socket and the subframe to move the socket laterally of the forward end portion of the subframe for laterally adjusting the forward end portion of the longitudinal conveyor.

3. The structure as defined in claim 2 wherein said transverse conveyor includes retractable wheel means disposed rearwardly of the frame and disposed above a supporting ground surface when the longitudinal conveyor is in an upwardly and rearwardly inclined position and engaging the ground surface when the forward end portion of the longitudinal conveyor is elevated thereby lifting the rearward portion of the longitudinal conveyor off of the frame so that by supporting the forward end portion of the longitudinal conveyor in elevated position above the ground surface, the subframe may be detached from the longitudinal conveyor and the mobile frame utilized for other purposes.

4. The structure as defined in claim 3 wherein said mobile frame is provided with a prime mover, drive wheels and steerable wheels to enable manipulation thereof by an operator, said subframe being pivoted to the frame for movement about a transverse axis and projecting forwardly of the frame.

5. The structure as defined in claim 4 wherein said socket is mounted on the forward end of the subframe, said support, guide and moving means for the socket including a transverse support member adapted to receive earth working tools or implements to enable the machine to be used for various purposes.

6. The structure as defined in claim 5 wherein said earth working implement on the forward end of the longitudinal conveyor includes a forwardly opening scoop-like structure having a rearward end communicating with the upper flight of the longitudinal conveyor belt, means interconnecting the longitudinal conveyor and the implement for pivoting the implement about a transverse axis, said implement including an adjustable landside on one wall thereof, and a skid at the forward end of the longitudinal conveyor to limit the downward movement thereof into engagement with the supporting surface.

7. The structure as defined in claim 6 wherein said transverse conveyor is laterally adjustable in relation to the longitudinal conveyor for positioning the discharge end of the transverse conveyor in laterally projecting relation to either side of the machine.

8. The structure as defined in claim 7 wherein a transverse deflector is disposed rearwardly of the discharge end of the longitudinal conveyor and above the transverse conveyor to deflect material being discharged from the longitudinal conveyor belt onto the transverse conveyor belt.

9. The structure as defined in claim 8 wherein the return flight of the conveyor belt passes over a pair of spaced idler rollers, a tension roller engaging the belt between the idler rollers, the tension roller on the longitudinal conveyor belt being supported by pivot support arms supported from the longitudinal conveyor, and a weight on the pivotal support arms for biasing the tension roller downwardly to tension the longitudinal conveyor belt.

10. The structure as defined in claim 9 wherein said ball connection between the socket on the forward end of the subframe and the longitudinal conveyor includes a mounting plate longitudinally movably connected to the longitudinal conveyor to enable relative movement between the ball and socket connection longitudinally with respect to the longitudinal conveyor when the longitudinal conveyor is elevated by the subframe.

11. The structure as defined in claim 1 wherein said mobile frame includes a grader blade at the rearward end thereof, turntable means supporting the grader blade for adjustable orientation in a transverse and longitudinal relationship to the path of movement of the mobile frame to enable earth to be deposited laterally of the machine thereby enabling the conveyor means to pick up such deposited earth during a subsequent pass of the machine.

12. The structure as defined in claim 11 wherein said mobile frame includes an operator's station disposed laterally of but generally alongside of the longitudinal conveyor with the support plate on the longitudinal conveyor engaging upwardly extending retaining plates on an elevated support surface on the frame to preclude lateral movement of the rearward end of the longitudinal conveyor.

* * * * *